US011274505B2

(12) United States Patent
Stewart et al.

(10) Patent No.: US 11,274,505 B2
(45) Date of Patent: Mar. 15, 2022

(54) GRIPPER ASSEMBLY FOR A COILED TUBING INJECTOR

(71) Applicant: EnQuest Energy Solutions, LLC, Houston, TX (US)

(72) Inventors: Jamie Stewart, Houston, TX (US); Weldon Edward Brunson, Jr., Houston, TX (US); Gregory L. Pipal, Houston, TX (US); Derrick Daigle, Houston, TX (US)

(73) Assignee: EnQuest Energy Solutions, LLC, Houston, TX (US)

( * ) Notice: Subject to any disclaimer, the term of this patent is extended or adjusted under 35 U.S.C. 154(b) by 0 days.

(21) Appl. No.: 17/179,632

(22) Filed: Feb. 19, 2021

(65) Prior Publication Data

US 2021/0262299 A1 Aug. 26, 2021

Related U.S. Application Data

(60) Provisional application No. 62/979,969, filed on Feb. 21, 2020.

(51) Int. Cl.
*E21B 19/22* (2006.01)
*E21B 19/08* (2006.01)

(52) U.S. Cl.
CPC ..... *E21B 19/08* (2013.01); *E21B 19/22* (2013.01)

(58) Field of Classification Search
CPC ..... E21B 19/08; E21B 19/22
See application file for complete search history.

(56) References Cited

U.S. PATENT DOCUMENTS

| | | | | |
|---|---|---|---|---|
| 6,173,769 | B1 * | 1/2001 | Goode | E21B 19/22 166/77.3 |
| 6,189,609 | B1 | 2/2001 | Shaaban et al. | |
| 6,230,955 | B1 | 5/2001 | Parks | |
| 6,332,501 | B1 | 12/2001 | Gipson | |
| 6,484,920 | B1 | 11/2002 | Selcer | |
| 6,527,055 | B1 | 3/2003 | Gipson | |
| 6,609,566 | B2 | 8/2003 | Perio, Jr. | |
| 6,892,810 | B2 | 5/2005 | Austbo et al. | |
| 7,857,042 | B2 | 12/2010 | Koopmans et al. | |
| 8,191,620 | B2 * | 6/2012 | Maschek, Jr. | E21B 19/22 166/77.3 |
| 8,267,183 | B1 | 9/2012 | Maschek, Jr. et al. | |
| 9,243,463 | B2 | 1/2016 | Hassard | |
| 9,316,068 | B2 | 4/2016 | Crnogorac et al. | |
| 9,371,706 | B2 | 6/2016 | Gubbins et al. | |
| 9,428,973 | B2 | 8/2016 | Park | |
| 9,739,104 | B2 | 8/2017 | Bjornenak | |
| 9,770,805 | B2 | 9/2017 | Livescu et al. | |
| 10,000,980 | B2 * | 6/2018 | Bjornenak | E21B 17/20 |
| 10,077,619 | B2 * | 9/2018 | Bjornenak | E21B 17/20 |
| 10,100,591 | B2 | 10/2018 | Hassard | |

(Continued)

*Primary Examiner* — Matthew R Buck
(74) *Attorney, Agent, or Firm* — Conley Rose, P.C.

(57) ABSTRACT

A gripper assembly for a coiled tubing injector includes a gripper block configured to grip a tubular member, wherein the gripper block includes a gripper key and a channel, and a carrier configured to couple to a chain of the coiled tubing injector, wherein the carrier includes a carrier key, wherein the carrier key is receivable within the channel of the gripper block whereby the gripper block encloses the carrier key and the gripper key interlocks with the carrier key.

18 Claims, 13 Drawing Sheets

(56) References Cited

U.S. PATENT DOCUMENTS

| | | | | |
|---|---|---|---|---|
| 10,113,376 | B2 * | 10/2018 | Bjornenak | E21B 19/08 |
| 10,161,203 | B2 | 12/2018 | Hassard et al. | |
| 10,184,588 | B2 | 1/2019 | Vehmeijer et al. | |
| 10,287,833 | B2 | 5/2019 | Hassard et al. | |
| 10,392,875 | B2 | 8/2019 | Basler | |
| 2014/0290932 | A1 * | 10/2014 | Crnogorac | B65G 15/14<br>166/77.3 |
| 2015/0361739 | A1 * | 12/2015 | Quirion | E21B 19/22<br>166/379 |

* cited by examiner

GRIPPER ASSEMBLY FOR A COILED TUBING INJECTOR

CROSS-REFERENCE TO RELATED APPLICATIONS

This application claims benefit of U.S. provisional patent application Ser. No. 62/979,969 filed Feb. 21, 2020, and entitled "Gripper Assembly for a Coiled Tubing Injector," which is hereby incorporated herein by reference in its entirety for all purposes.

STATEMENT REGARDING FEDERALLY SPONSORED RESEARCH OR DEVELOPMENT

Not applicable.

BACKGROUND

Coiled tubing systems are used to run continuous pipe into and out of wellbores. Continuous pipe may be referred to as coiled tubing because it is stored on a large reel. Coiled tubing can be used for drilling operations, and is likewise well-suited for servicing and/or producing hydrocarbons from existing wells. Coiled tubing can be inserted into and removed from a wellbore extending through a subterranean earthen formation without having to first erect a complex drilling rig or other structure at a well site at which the wellbore is located. In some application, the coiled tubing system includes a coiled tubing injector positioned over the wellbore, the coiled tubing injector including a pair of endless chains upon which a plurality of gripper assemblies are mounted. The gripper assemblies may grip the coiled tubing and, via the actuation of the pair of endless chains, drive the coiled tubing through the coiled tubing injector to inject the coiled tubing into the wellbore or retract the coiled tubing therefrom.

BRIEF SUMMARY OF THE DISCLOSURE

An embodiment of a gripper assembly for a coiled tubing injector comprises a gripper block configured to grip a tubular member, wherein the gripper block comprises a gripper key and a channel, and a carrier configured to couple to a chain of the coiled tubing injector, wherein the carrier comprises a carrier key, wherein the carrier key is receivable within the channel of the gripper block whereby the gripper block encloses the carrier key and the gripper key interlocks with the carrier key. In some embodiments, the gripper block comprises a first end, a second end opposite the first end, a bottom surface, a pair of gripper lateral sides extending between the first end and the second end, a gripper surface configured to grip the tubular member, and a rail positioned along one of the first end and the second end of the gripper block and extending from the bottom surface of the gripper block and oriented opposite the gripper surface. In some embodiments, the gripper key extends orthogonally from the rail, and wherein the gripper key and the rail define the channel in which the carrier key is receivable. In certain embodiments, the carrier comprises a first end, a second end opposite the first end, a pair of carrier lateral sides extending between the first end and the second end, and a top surface configured to slidably engage the bottom surface of the gripper block, and wherein the carrier key extends from one of the pair of carrier lateral sides. In certain embodiments, the gripper block has a maximum length extending between the first end and the second end and a maximum width extending between the pair of gripper lateral sides, wherein the maximum length is greater than the maximum width, the carrier has a maximum length extending between the first end and the second end and a maximum width extending between the pair of carrier lateral sides, wherein the maximum length of the carrier is greater than the maximum width of the carrier, and the maximum length of the gripper block is greater than the maximum width of the carrier. In some embodiments, the carrier comprises a ledge extending from the top surface and configured to engage one of the pair of gripper lateral sides when the carrier key is received within the channel of the gripper block. In some embodiments, a plurality of the gripper keys are positioned along the first end and the second end of the gripper block, a plurality of the carrier keys are positioned along the pair of carrier lateral sides, and the plurality of carrier keys define a plurality of gaps extending between adjacently positioned carrier keys of the plurality of carrier keys, and wherein each of the plurality of gripper keys are displaceable through the plurality of gaps. In some embodiments, the gripper assembly further comprises a clip coupled to the carrier and receivable within a receptacle extending into one of the pair of gripper lateral sides to lock the gripper block to the carrier. In some embodiments, the clip comprises a first end coupled to the carrier, a second end opposite the first end and comprising a handle, and an indent positioned between the first end and the second end and comprising a bend of between 30 and 120 degrees.

An embodiment of a coiled tubing injector comprises a frame, wherein a drive sprocket is coupled to the frame, a chain driven by the drive sprocket, wherein a plurality of gripper assemblies are coupled to the chain, a traction skate configured to apply a clamping force against the plurality of gripper assemblies, wherein at least one gripper assembly of the plurality of gripper assemblies comprises a gripper block configured to grip a tubular member, wherein the gripper block comprises a gripper key and a channel, a carrier configured to couple to a chain of the coiled tubing injector, wherein the carrier comprises a carrier key, wherein the carrier key is receivable within the channel of the gripper block whereby the gripper block encloses the carrier key and the gripper key interlocks with the carrier key. In some embodiments, the gripper block comprises a first end, a second end opposite the first end, a bottom surface, a pair of gripper lateral sides extending between the first end and the second end, a gripper surface configured to grip the tubular member, and a rail positioned along one of the first end and the second end of the gripper block and extending from the bottom surface of the gripper block oriented opposite the gripper surface. In some embodiments, the gripper key extends orthogonally from the rail, and wherein the gripper key and the rail define the channel in which the carrier key is receivable. In certain embodiments, the carrier comprises a first end, a second end opposite the first end, a pair of carrier lateral sides extending between the first end and the second end, and a top surface configured to slidably engage the bottom surface of the gripper block, and wherein the carrier key extends from one of the pair of carrier lateral sides. In certain embodiments, the gripper block has a maximum length extending between the first end and the second end and a maximum width extending between the pair of gripper lateral sides, wherein the maximum length is greater than the maximum width, the carrier has a maximum length extending between the first end and the second end and a maximum width extending between the pair of carrier lateral sides, wherein the maximum length of the carrier is greater than the maximum width of the carrier, and the maximum length of the gripper block is greater than the maximum width of the carrier. In some embodiments, the carrier comprises a ledge extending from the top surface and configured to engage one of the pair of gripper lateral sides when the carrier key is received within the channel of the gripper block, and the at least one gripper block assembly of the plurality of gripper block assembly further comprises a clip coupled to the carrier and receivable within a receptacle extending into one of the pair of gripper lateral sides to lock the gripper block to the carrier. In some embodiments, the clip comprises a first end coupled to the carrier, a second end opposite the first end and comprising a handle, and an indent positioned between the first end and the second end and comprising a bend of between 30 and 120 degrees.

An embodiment of a method of assembling a gripper assembly for a coiled tubing injector comprises (a) displacing a gripper block of the gripper assembly relative to a carrier of the gripper assembly in a first direction whereby a gripper key of a gripper block of the gripper assembly is displaced through a gap formed between adjacently positioned carrier keys of the carrier, and (b) displacing the gripper block relative to the carrier in a second direction orthogonal to the first direction whereby at least one of the carrier keys is received in a channel of the gripper block such that the gripper block encloses the at least one carrier key received in the channel and the gripper key interlocks with the at least one carrier key. In some embodiments, the method further comprises (c) flexing a clip coupled to the carrier as the gripper block is displaced relative to the carrier in the first direction into an unlocked position whereby the gripper key is permitted to displace through the gap formed between the adjacently positioned carrier keys, and (d) releasing the clip following (b) whereby the clip flexes into a locked position locking the gripper block to the carrier. In some embodiments, the gripper block comprises a first end, a second end opposite the first end, a pair of gripper lateral sides extending between the first end and the second end, a gripper surface configured to grip the tubular member, and a rail positioned along one of the first end and the second end of the gripper block and extending from a bottom surface of the gripper block oriented opposite the gripper surface, and the carrier comprises a first end, a second end opposite the first end, a pair of carrier lateral sides extending between the first end and the second end, and a top surface configured to slidably engage the bottom surface of the gripper block, and wherein the carrier key extends from one of the pair of carrier lateral sides. In certain embodiments, the gripper block has a maximum length extending between the first end and the second end and a maximum width extending between the pair of gripper lateral sides, wherein the maximum length is greater than the maximum width, the carrier has a maximum length extending between the first end and the second end and a maximum width extending between the pair of carrier lateral sides, wherein the maximum length of the carrier is greater than the maximum width of the carrier, and the maximum length of the gripper block is greater than the maximum width of the carrier.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of exemplary embodiments of the disclosure, reference will now be made to the accompanying drawings in which.

DETAILED DESCRIPTION OF EXEMPLARY EMBODIMENTS

Figure 1:
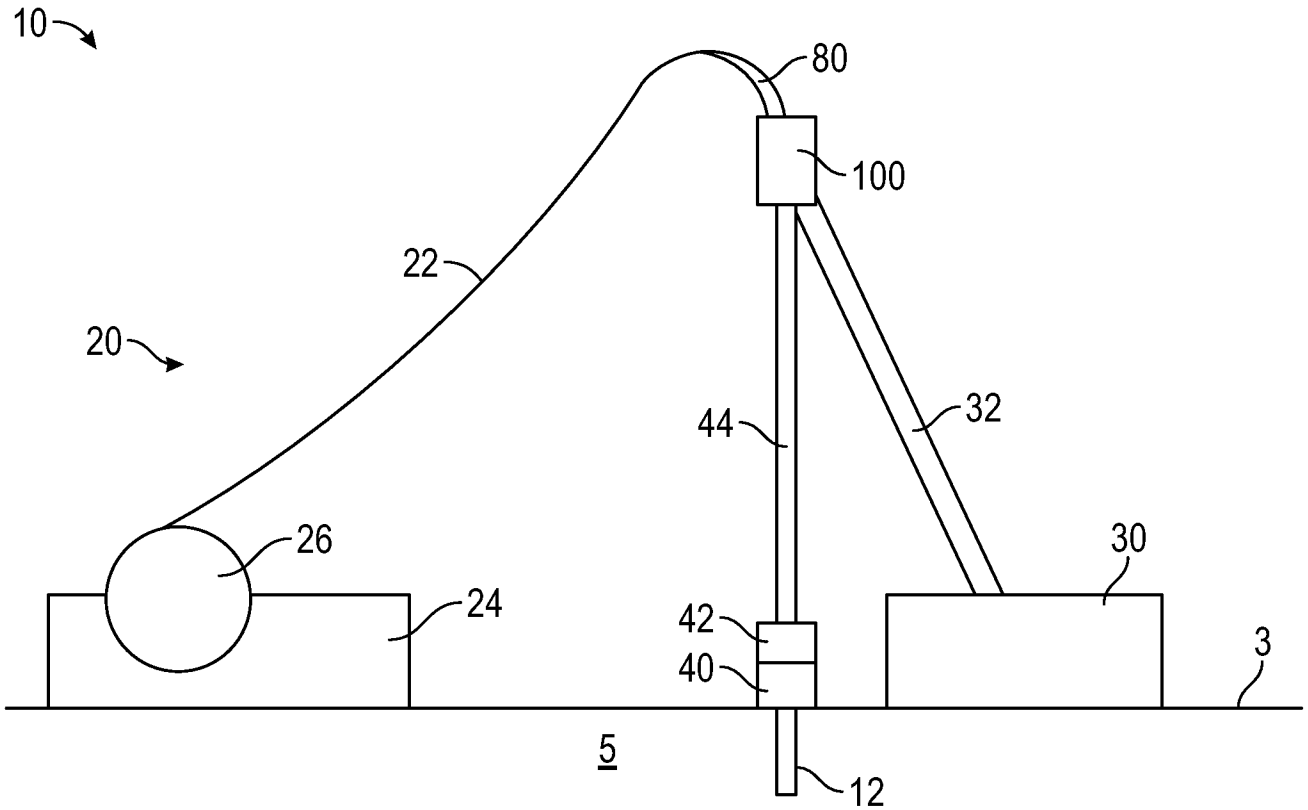
FIG. 1 is a schematic view of an embodiment of a well system including a coiled tubing system in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness. Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

As previously described, coiled tubing injectors may utilize a plurality of gripper assemblies to grip coiled tubing extending through and driven by the coiled tubing injector. Each gripper assembly may comprise a carrier coupled to one of the endless chains and a gripper block releasably coupled to the carrier to allow for the replacement of the gripper block during the operational life of the coiled tubing injector. For example, the gripper block may be replaced with a gripper block having a different gripping surface (e.g., a gripping surface having a different diameter, etc.) to accommodate coiled tubing having different properties such as a different size or diameter.

Given that each coiled tubing injector may comprise a relatively large number of grippers, it is advantageous to minimize the cost of producing each gripper to thereby minimize the cost of producing the coiled tubing injector. Embodiments disclosed herein include gripper assemblies comprising replaceable gripper blocks which may be releasably coupled to a corresponding carrier of the gripper assembly. Particularly, embodiments of gripper assemblies disclosed herein include gripper blocks configured to slide over and partially surround or enclose the corresponding carrier to allow for the gripper block to slidably lock onto or couple with the carrier. As will be discussed further herein, the arrangement of sliding the gripper block over the carrier may minimize the manufacturing costs associated with producing each gripper assembly while providing a convenient mechanism by which an operator of the coiled tubing injector may quickly couple or decouple a gripper block from a corresponding carrier.

Referring to FIG. 1, an embodiment of a well system 10 comprising a coiled tubing system 20 located at a surface 3 is shown. In the embodiment of FIG. 1, well system 10 comprises a system for servicing or completing a wellbore 12 extending through a subterranean earthen formation 5; however, in other embodiments, well system 10 may comprise a system for drilling wellbore 12 or a system for producing hydrocarbons from wellbore 12.

Coiled tubing system 20 is generally configured to inject or stab coiled tubing 22 into wellbore 12 and pull or retract coiled tubing 22 from wellbore 12. In this embodiment, coiled tubing system 20 generally includes a reel truck 24 comprising a reel 26, a mast truck 30 comprising a mast 32, a wellhead 40, a blowout preventer (BOP) 42, and a coiled tubing injector 100; however, in other embodiments, the configuration of coiled tubing system 20 may vary. Coiled tubing 22 of coiled tubing system 20 is supplied from reel 26 of reel truck 24. The unwinding from and winding onto reel 26 of coiled tubing 22 may be performed or assisted by a tubing tensioner (not shown) of reel truck 24 powered by a hydraulic unit (not shown). The displacement of coiled tubing 22 into and out of wellbore 12 may also be facilitated by a guide arch 80 extending from coiled tubing injector 100. Mast 32 of coiled tubing system 20 extends telescopically from mast truck 30 and is coupled to and physically supports coiled tubing injector 100 at a location distal mast truck 30. Along with being telescopically adjustable, mast 32 may also be swiveled or rotated relative to mast truck 30 to control the positioning of coiled tubing injector 100 relative to wellbore 12. In this manner, mast 32 may align coiled tubing injector 100 with wellhead 40 and BOP 42 to ensure smooth feeding of coiled tubing 22 into and out of wellbore 12. Mast truck 30 may also include a winch (not shown) for pulling a terminal end of coiled tubing 22 through coiled tubing injector 100 following the insertion of coiled tubing 22 into coiled tubing injector 100.

Wellhead 40 is positioned at the surface of wellbore 12 and physically supports BOP 42 which is mounted or coupled thereto. BOP 42 may be used to control the circulation of fluids from wellbore 12 and the surrounding environment at the surface 3. In this embodiment, a lubricator string 44 extends from BOP 42 to coiled tubing injector 100 and which provides lubrication to coiled tubing 22 as coiled tubing is extended into or retracted from wellbore 12. A variety of tools may be coupled to the terminal end of coiled tubing 22 for performing various operations in wellbore 12. For example, a perforating tool may be coupled to the terminal end of coiled tubing 22 for selectably perforating a casing string positioned in wellbore 12 whereby fluid connectivity between formation 5 and wellbore 12 may be enhanced. Reel truck 24 may include a control room (not shown) for transmitting signals to and receiving signals from (e.g., electronic signals and/or data) tools attached to the terminal end of coiled tubing 22. Additionally, fluids may be transported between reel truck 24 and tools attached to the terminal end of coiled tubing 22 via one or more fluid flow passages extending through coiled tubing 22.

Figure 2:
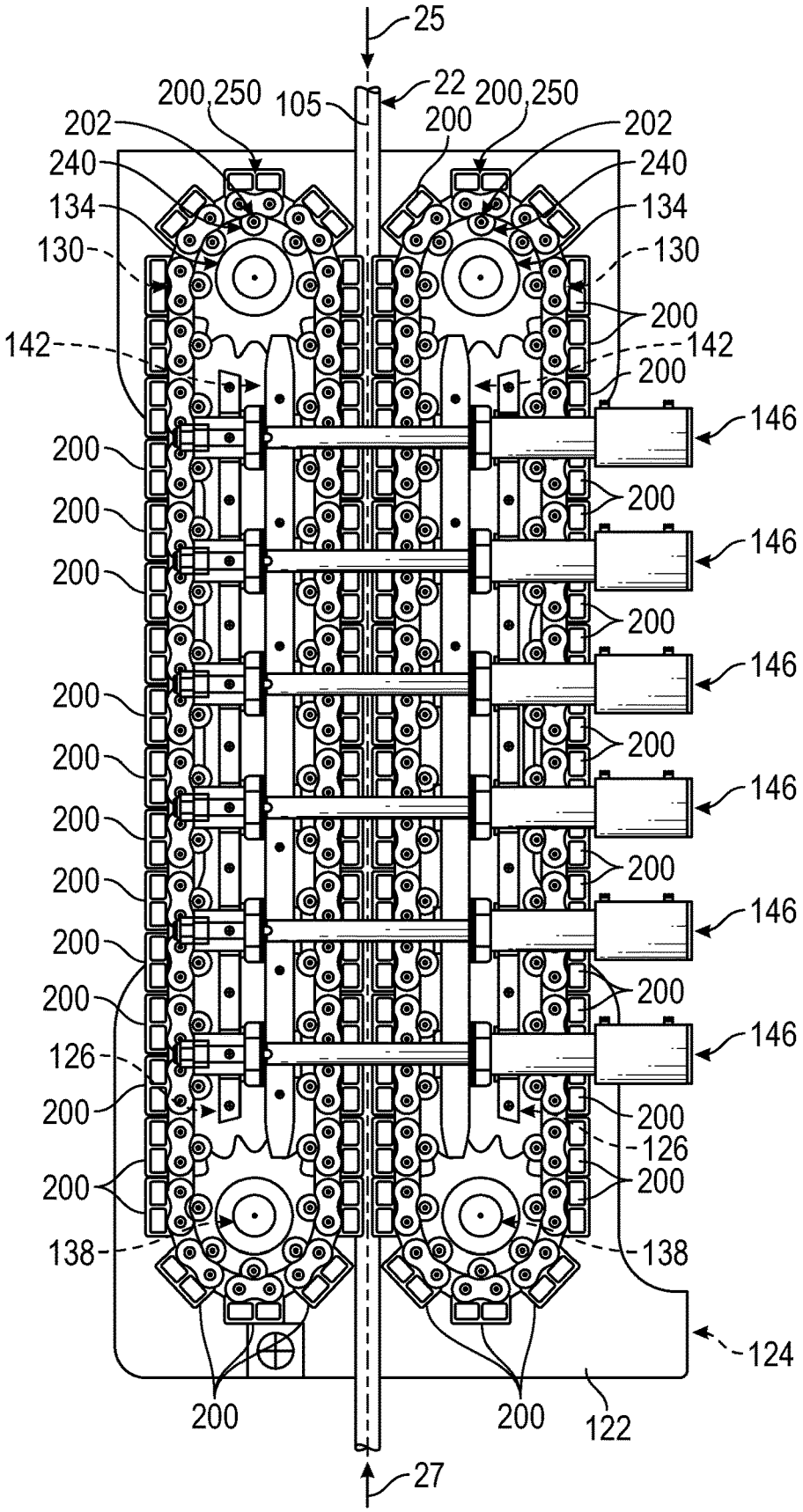
FIG. 2 is a side view of an embodiment of a coiled tubing injector of the coiled tubing system of FIG. 1 in accordance with principles disclosed herein.

Referring to FIG. 2, an embodiment of the coiled tubing injector 100 of coiled tubing system 20 is shown. Coiled tubing injector 100 is configured to frictionally grip coiled tubing 22 to thereby stab coiled tubing 22 into wellhead 12 or retract coiled tubing 22 therefrom. In the embodiment of FIG. 2, coiled tubing injector 100 has a longitudinal or central axis 105 and generally includes a body or frame 122, a pair of endless chains 130, a pair of drive sprockets 134, a pair of idler sprockets 138, a pair of traction skates 142, a plurality of traction actuators 146, and a plurality of gripper assemblies 200 (only some of which are labeled in FIG. 2 for clarity); however, the configuration of coiled tubing injector 100 may vary in other embodiments.

The frame 122 of coiled tubing injector 100 provides physical support to the components thereof and may couple with the mast 32 of mast truck 30 described above. In this embodiment, frame 122 comprises a pair of side plates 124

(only one of which is shown in FIG. 2 for clarity) each extending along central axis 105 and a plurality of cross-bars or cross-plates 126 each extending between the pair of side plates 124. In this configuration, coiled tubing 22, endless chains 130, and gripper assemblies 200 may each be positioned between the pair of side plates 124 of frame 122. Endless chains 130 of coiled tubing injector 100 rotate in opposite rotational directions (e.g., clockwise and counterclockwise) to drive coiled tubing 22 in either a first direction (indicated by arrow 25 in FIG. 2) along central axis 105 towards wellbore 12, and a second direction (indicated by arrow 27 in FIG. 2) along central axis 105 and away from wellbore 12. In this embodiment, each endless chain 130 comprises a segmented chain including a pair of opposing chain plates and pins and rollers extending between the pair of chain plates; however, in other embodiments, the configuration of each endless chain 130 may vary.

Each endless chain 130 of coiled tubing injector 100 is continuous and runs over one of the pair of drive sprockets 134 and one of the pair of idler sprockets 138. Each drive sprocket 134 is positioned opposite one of the idler sprockets 138 thereby defining an oval-shaped path for each endless chain 130. Each drive sprocket 134 is coupled to a motor (not shown in FIG. 2) for rotating the drive sprocket 134 and driving the endless chain 130 that runs over the drive sprocket 134. Each traction skate 142 comprises an elongate member extending parallel to central axis 105 of coiled tubing injector 100. Each traction skate 142 is orthogonally moveable relative to central axis 105. Particularly, traction actuators 146 are coupled to traction skates 142 and are configured to selectably apply a clamping force to traction skates 142 to urge skates 142 towards central axis 105 and against the gripper assemblies 200 positioned between traction skates 142 and coiled tubing 22. In this manner, the amount of contact force between gripper assemblies 200 and coiled tubing 22 may be controlled by the actuation of traction actuators 146. A plurality of the traction actuators 146 are provided along the length of coiled tubing injector 100 to ensure pressure is evenly applied along traction skates 142 in the direction of central axis 105. In this embodiment, traction actuators 146 each comprise a hydraulic cylinder; however, in other embodiments, the configuration of each traction actuator 146 may vary.

As will be discussed further herein, each gripper assembly 200 of coiled tubing injector 100 generally comprises a carrier 202 and a gripper member or block 250 coupled thereto. The carrier 202 of each gripper assembly 200 couples to one of the pair of endless chains 130 and comprises one or more roller bearings 240 which rollably engage one of the pair of traction skates 142. Bearings 240 reduce friction between traction skates 142 and gripper assemblies 200 as traction skates 142 clamp gripper assemblies 200 against coiled tubing 22. The gripper block 250 of each gripper assembly 200 is generally configured to frictionally contact or grip an outer surface of the coiled tubing 22 whereby relative movement between gripper block 250 and coiled tubing 22 is restricted or at least mitigated. In this manner, the gripper blocks 250 of gripper assemblies 200 may frictionally drive coiled tubing 22 along central axis 105 in either the first direction 25 or second direction 27.

Figure 3:
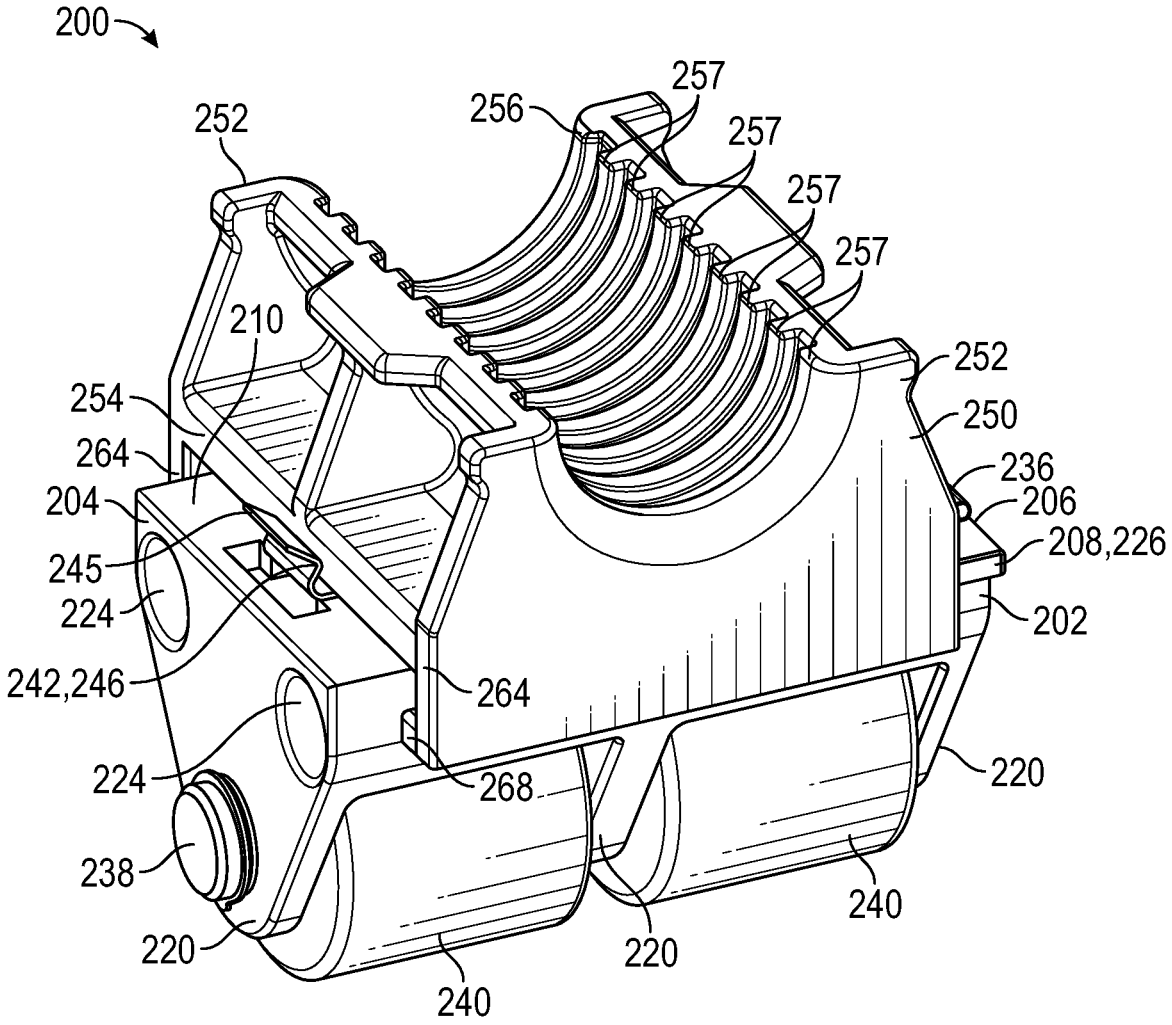
FIGS. 3, 4 are perspective views of an embodiment of a gripper assembly of the coiled tubing injector of FIG. 2 in accordance with principles disclosed herein.
Figure 4:
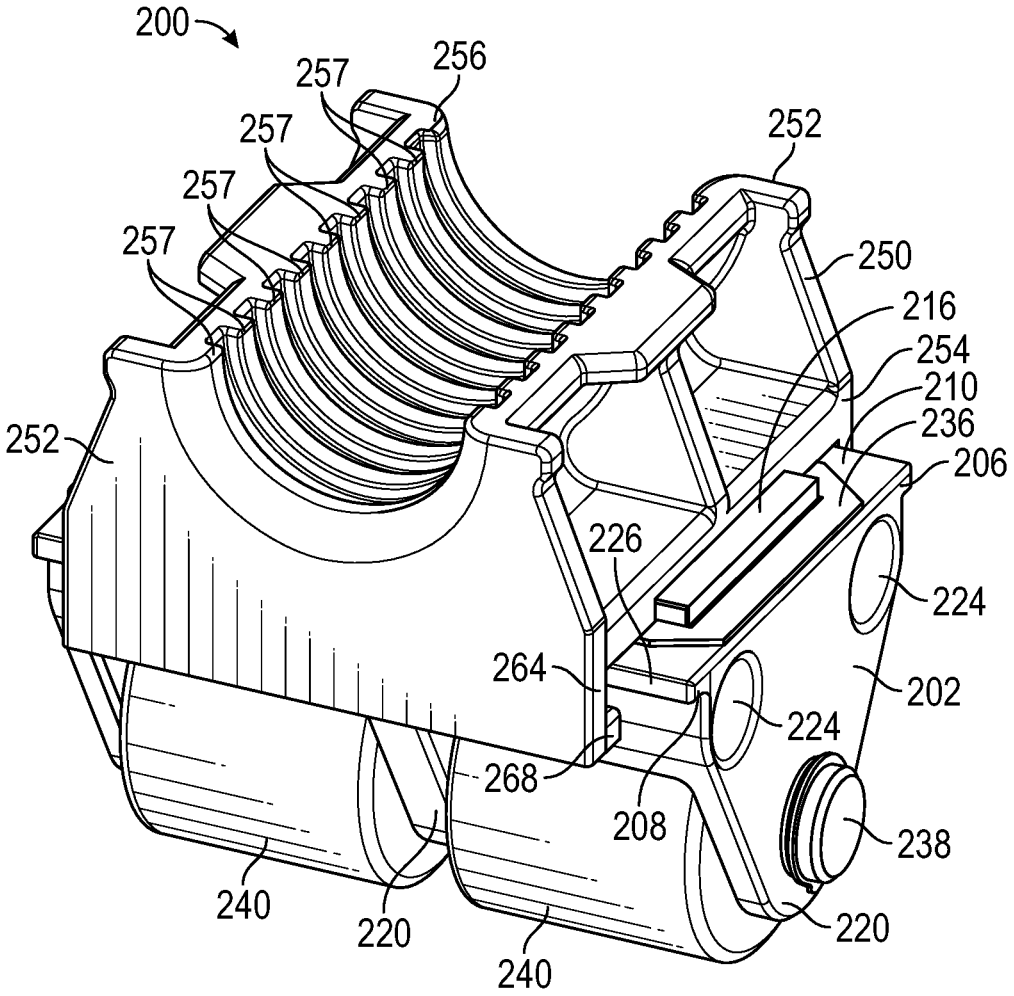
Figure 5:
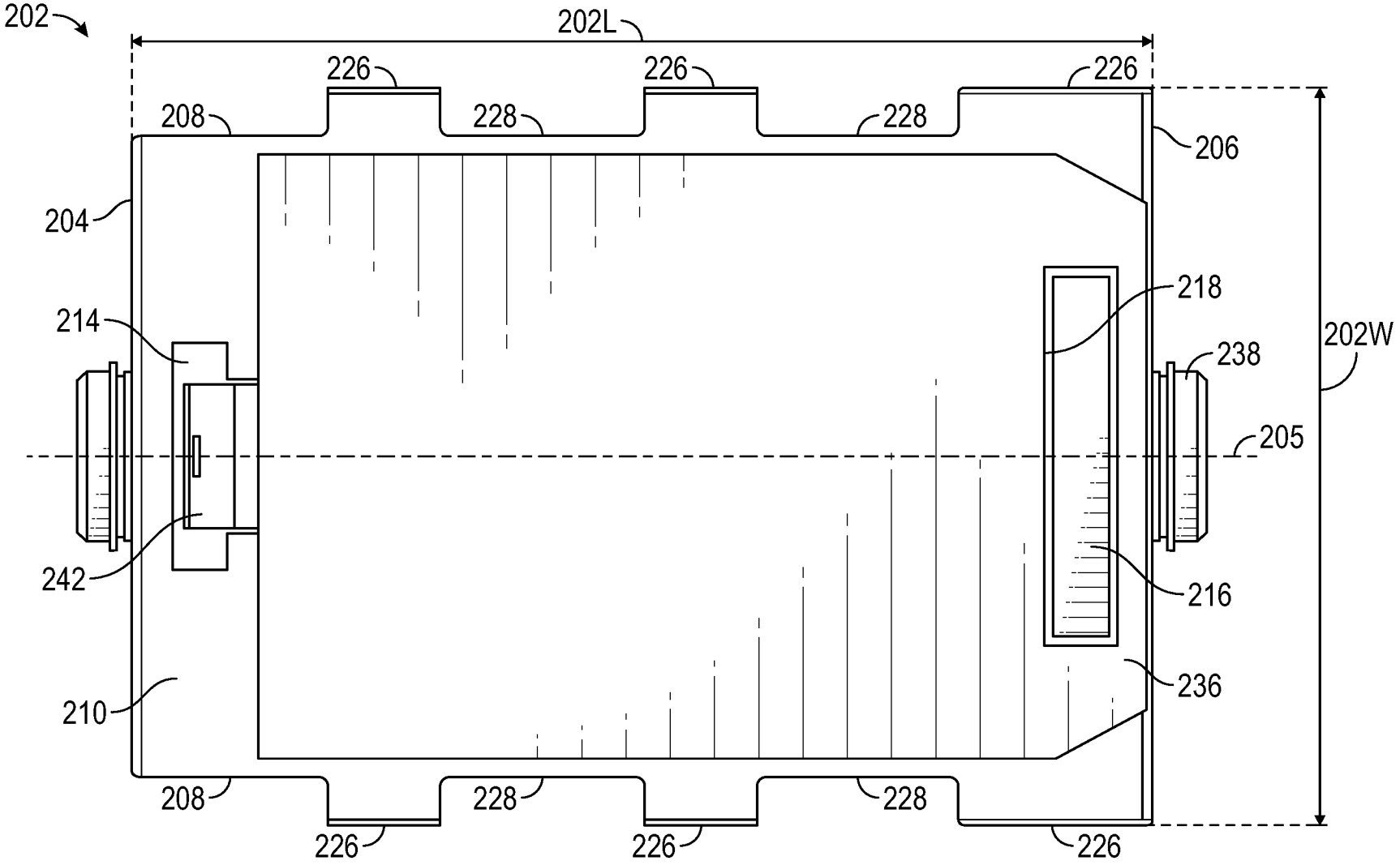
FIG. 5 is a top view of an embodiment of a carrier of the gripper assembly of FIGS. 3, 4 in accordance with principles disclosed herein.
Figure 6:
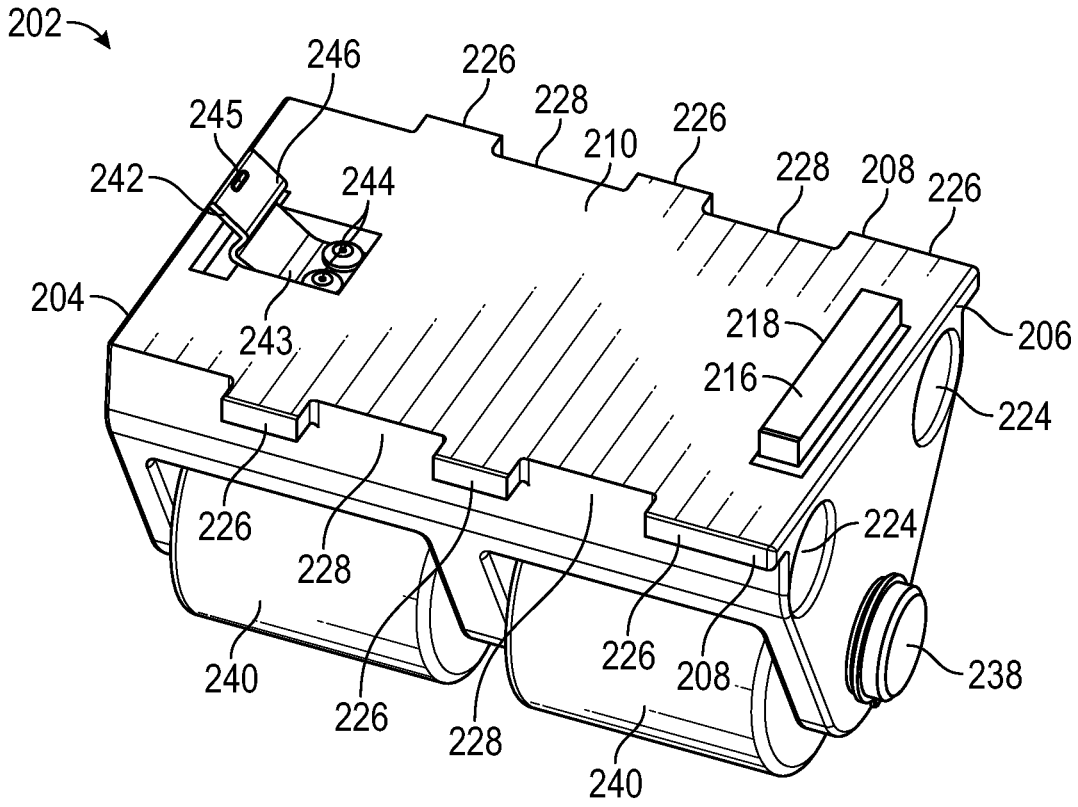
FIG. 6 is a perspective view of the carrier of FIG. 5.
Figure 7:
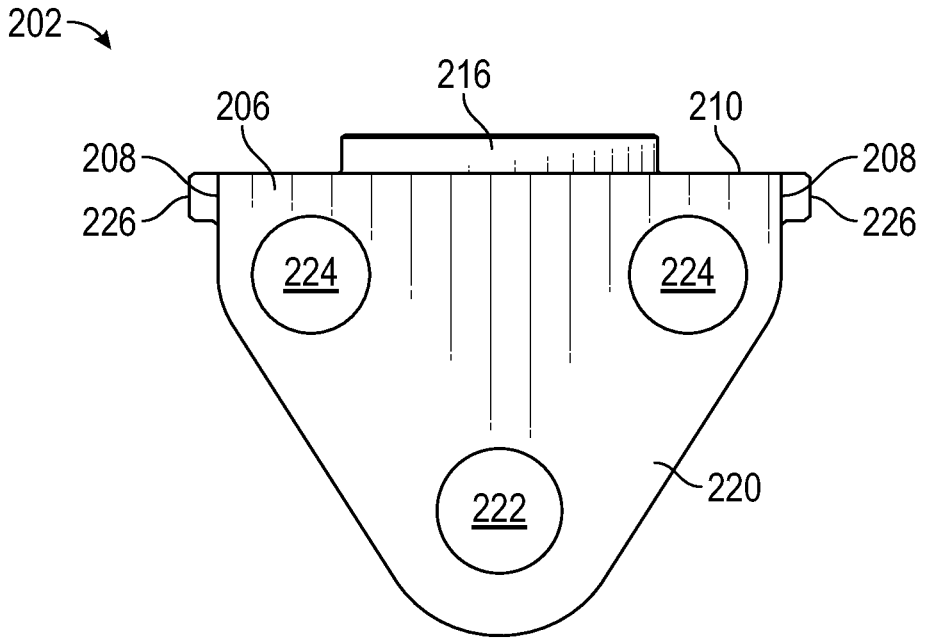
FIG. 7 is a front view of the carrier of FIG. 5.
Figure 8:
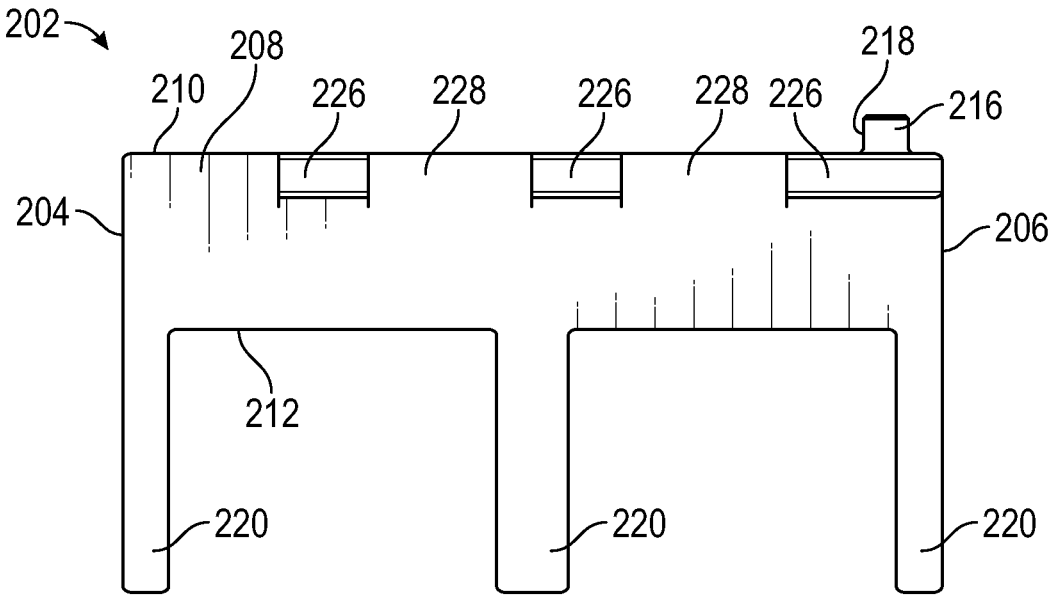
FIG. 8 is a side view of the carrier of FIG. 5.
Figure 9:
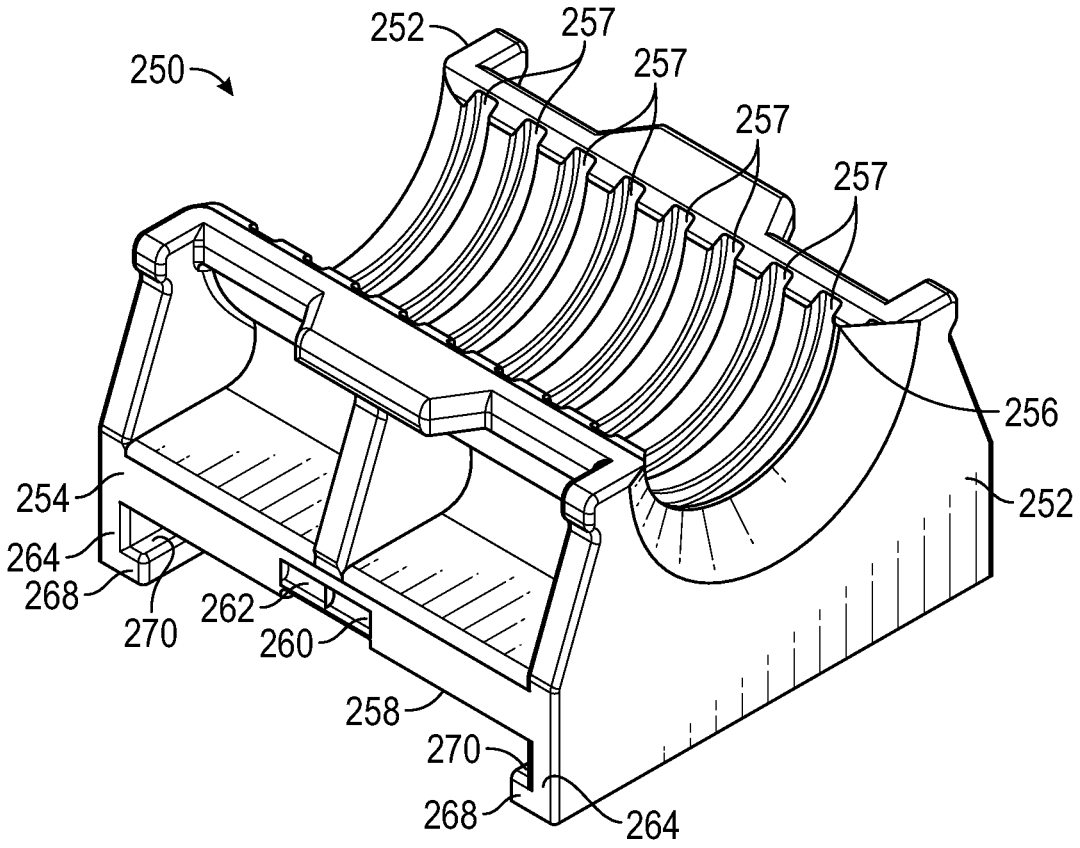
FIG. 9 is a view of an embodiment of a gripper block of the gripper assembly of FIGS. 3, 4 in accordance with principles disclosed herein.
Figure 10:
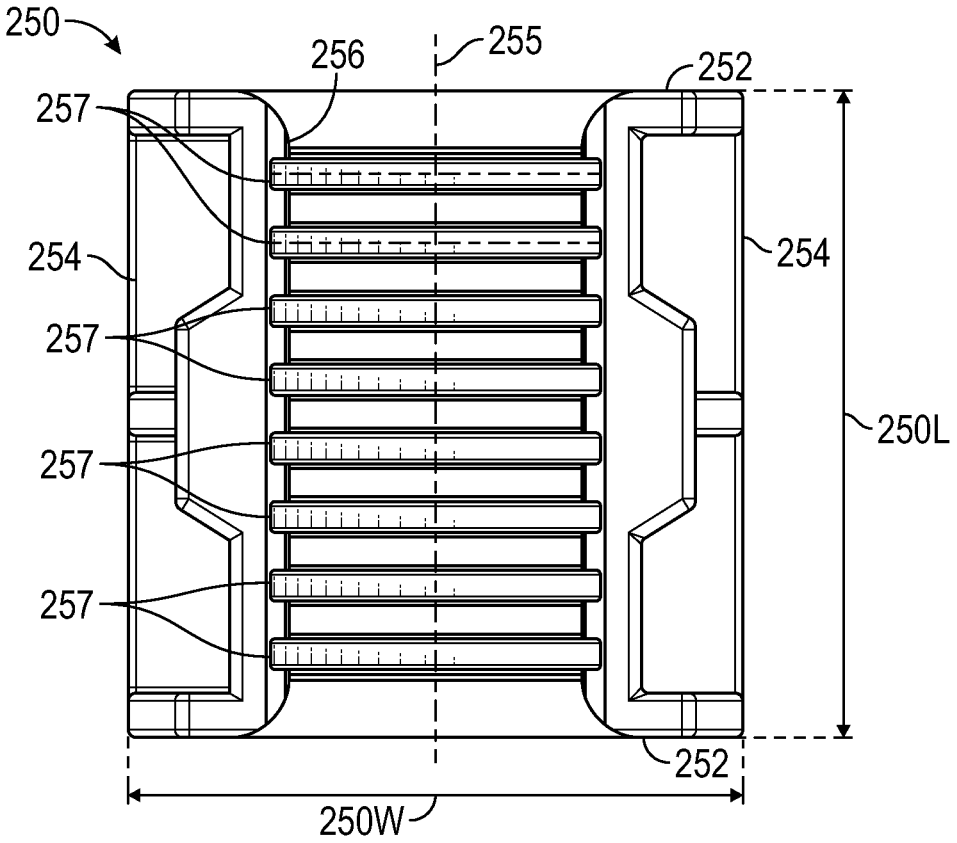
FIG. 10 is a top view of the gripper block of FIG. 9.
Figure 11:
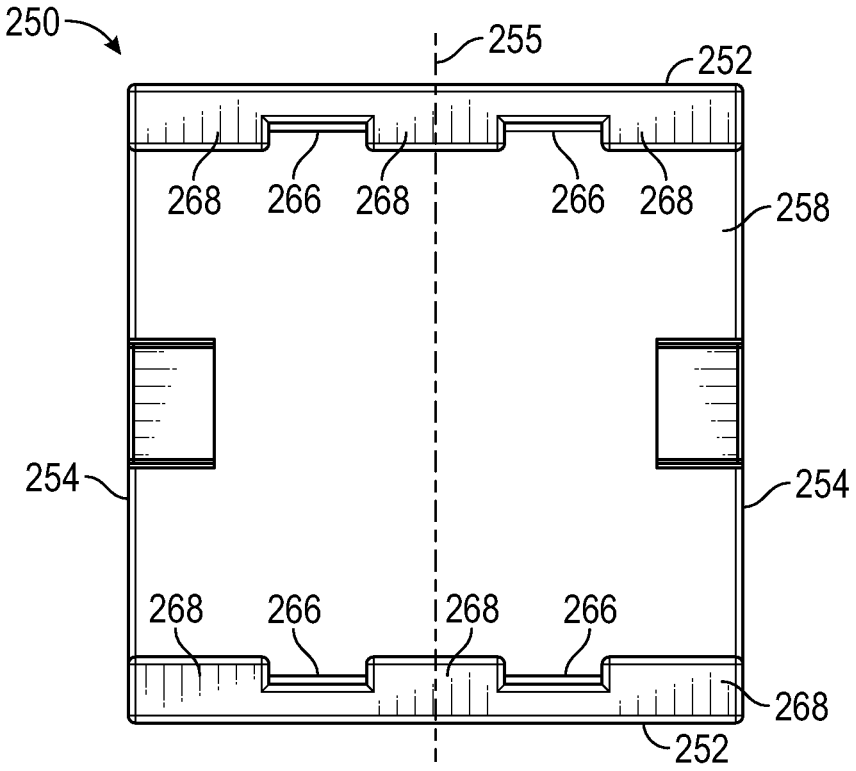
FIG. 11 is a bottom view of the gripper block of FIG. 9.
Figure 12:
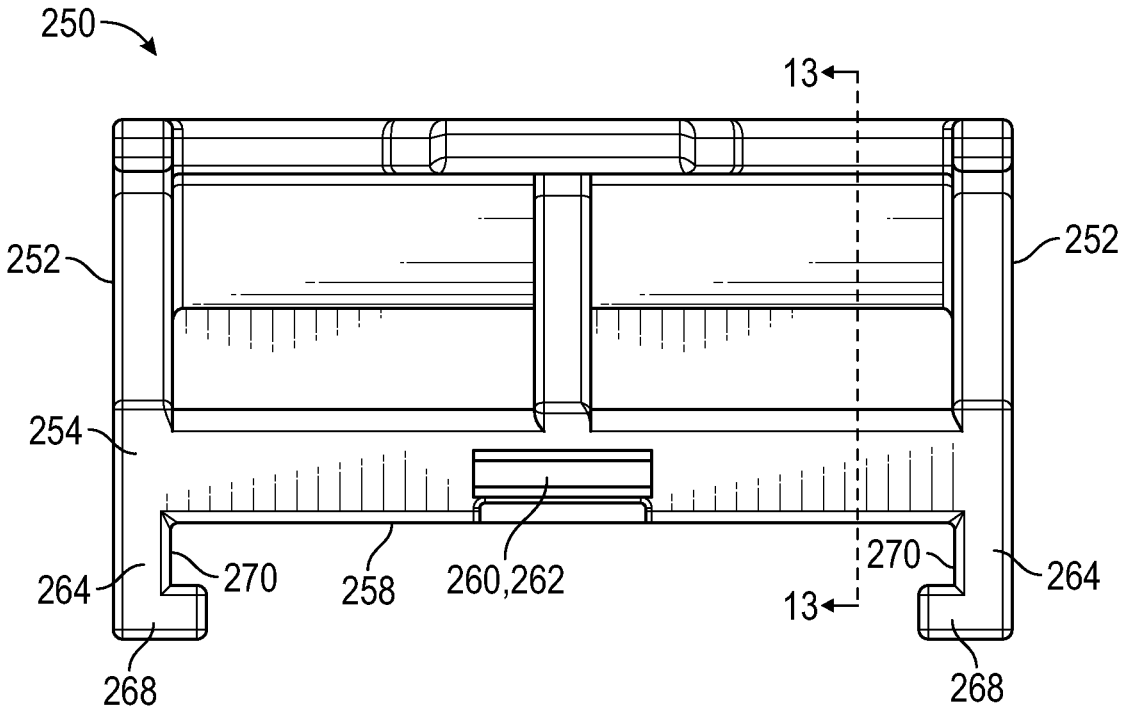
FIG. 12 is a side view of the gripper block of FIG. 9.
Figure 13:
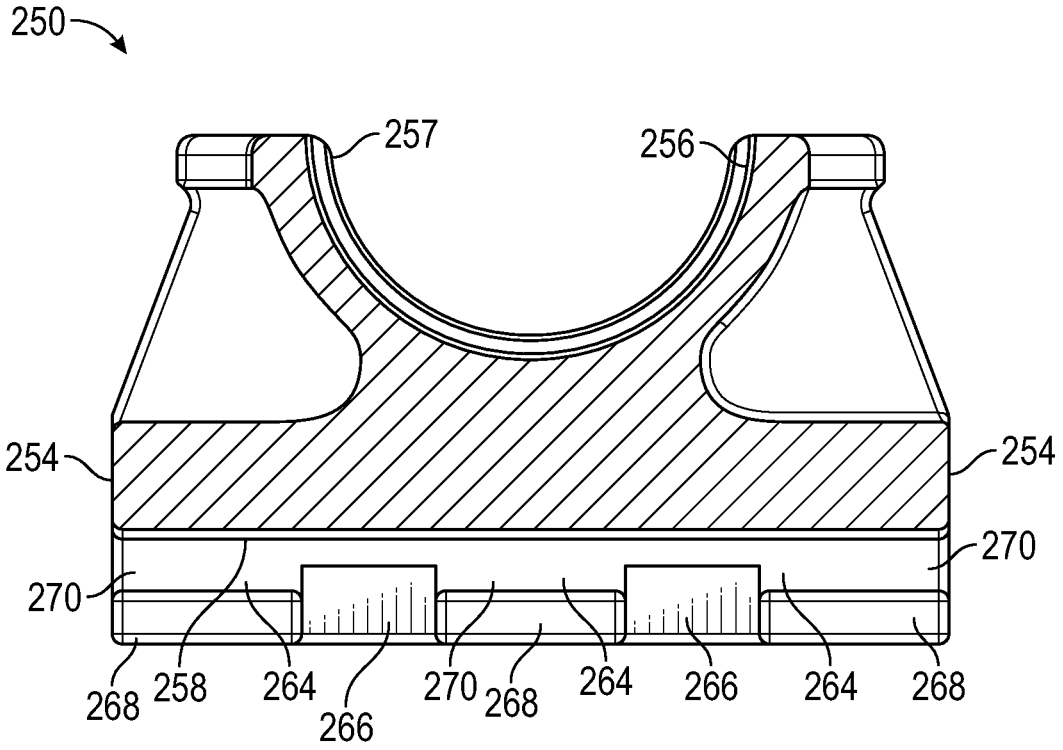
FIG. 13 is a cross-sectional view along lines 13-13 of FIG. 12 of the gripper block of FIG. 9.

Referring to FIGS. 3, 4 an embodiment of one of the gripper assemblies 200 of coiled tubing injector 100 is shown. Although in this embodiment gripper assemblies 200 comprise components of coiled tubing injector 100, in other embodiments, gripper assemblies 200 may be utilized in other coiled tubing injectors which vary in configuration from coiled tubing injector 100. As described above, gripper assembly 200 generally includes carrier 202 (comprising roller bearings 240) and gripper block 250. Carrier 202 of gripper assembly 200 is coupled to or carries gripper block 250 and interfaces with one of the traction skates 142 whereby the clamping force applied to traction skates 142 from traction actuators 146 may be transferred to the gripper block 250 of gripper assembly 200 while friction between gripper assembly 200 and the traction skate 142 is minimized via bearings 240 of carrier 202. Also as described above, gripper block 250 of gripper assembly 200 frictionally engages or contacts the outer surface of coiled tubing 22 to forcibly direct or drive coiled tubing 22 along the central axis 105 of coiled tubing injector 100. In this embodiment, gripper block 250 is releasably coupled to carrier 202 such that gripper block 250 may be replaced during the service life of coiled tubing injector 100 in the event that gripper block 250 becomes worn or otherwise unsuitable for operation in coiled tubing injector 100. Moreover, gripper block 250 may need to be replaced with a gripper block having a different configuration, such as a smaller or larger diameter surface for gripping the coiled tubing 22.

Referring to FIGS. 3-8, views of the carrier 202 of gripper assembly 200 are shown in FIGS. 5-8. Carrier 202 of gripper assembly 200 has a central or longitudinal axis 205 (shown in FIG. 5), a longitudinal first end 204, a longitudinal second end 206 opposite first end 204, and a pair of opposing lateral sides 208 extending between ends 204, 206. Carrier 202 includes a planar first or top surface 210 and a planar second or bottom surface 212 oriented opposite top surface 210, where surfaces 210, 212 are each defined by ends 204, 206 and sides 208. The top surface 210 of carrier 202 includes a receptacle 214 located proximal first end 204 and configured for receiving a releasable connector or clip 242. As will be described further herein, clip 242 is configured to releasably couple gripper block 250 with carrier 202 whereby relative movement between gripper block 250 and carrier 202 is restricted. As shown particularly in FIG. 6, clip 242 comprises a base 243 fastened to carrier 202 via one or more fasteners 244 (e.g., screws, etc.) extending through the base 243 of clip 242 and into top surface 210. Additionally, clip 242 includes a terminal end comprising a handle 245 and a curved indent or lock 246 positioned between base 243 and handle 245. Lock 246 comprises a bend of approximately between 30 and 120 degrees in clip 242. In this embodiment, lock 246 comprises a bend of approximately 90 degrees.

Carrier 202 additionally includes an elongate ledge 216 positioned on top surface 210 proximal second end 206 and extending orthogonal central axis 205. As will be described further herein, ledge 216 includes a planar stop surface 218 that delimits relative movement between gripper assembly 250 and carrier 202 during the process of coupling gripper assembly 250 with carrier 202. In this embodiment, a gasket 236 is positioned on top surface 210 of carrier 202. Gasket 236 comprises a flexible material and, being positioned between gripper block 250 and carrier 202, allows gripper block 250 to flex relative to carrier 202 during the operation of coiled tubing injector 100. The relative movement provided by gasket 236 may reduce the potential for gripper block 250 to become damaged while engaging coiled tubing 22 while also ensuring constant contact and engagement between gripper block 250 and coiled tubing 22. While in this embodiment gripper assembly 200 includes gasket 236, in other embodiments, gripper assembly 200 may not include gasket 236 and instead no additional material or member may be positioned between gripper block 250 and carrier 202.

Carrier 202 further includes a plurality of triangular-shaped flanges 220 extending from bottom surface 212. Flanges 220 are spaced equidistantly along bottom surface 212 and each include an outer aperture 222 and a pair of inner apertures 224. The outer aperture 222 of each flange 220 receives a shaft 238 which extends through bearings 240 to couple bearings 240 with carrier 202 whereby bearings 240 may rotate relative to carrier 202. The inner apertures 224 of each flange 220 each receive a pin (not shown in FIGS. 3-8) of one of the endless chains 130 of coiled tubing injector 100 to couple carrier 202 with the endless chain 130.

Along each side 208 of carrier 202 are positioned a plurality of spaced locking members or carrier keys 226 positioned between surfaces 210, 212 and each extending orthogonally away from central axis 205. In this embodiment, each carrier key 226 has a generally rectangular cross-section; however, in other embodiments, the configuration of each carrier key 226 may vary. Additionally, a first carrier key 226 is positioned at second end 206, a second carrier key 226 is positioned axially adjacent or proximal aperture 214 formed in top surface 210, a third carrier key 226 is positioned equidistantly between the first two carrier keys 226. In this configuration, a pair of gaps 228 are formed between the three carrier keys 226 of carrier 202, each gap 228 extending between a pair of adjacent carrier keys 226. Additionally, a third gap 228 is formed that extends between first end 204 and a terminal end of the carrier key 226 positioned closest to first end 204. While in this embodiment carrier 202 includes three carrier keys 226 separated by gaps 228, in other embodiments, the number of carrier keys 226 and associated gaps 228 may vary. In this embodiment, carrier 202 has an axial maximum length 202L (shown in FIG. 5) extending along central axis 205 and between ends 204, 206, and a maximum width 202W extending orthogonal central axis 205 and between and defined by opposing carrier keys 226 formed on sides 208 of carrier 202. In this embodiment, the maximum length 202L of carrier 202 is greater than the maximum width 202W of carrier 202.

Referring to FIGS. 3, 4, and 9-13, views of the gripper block 250 of gripper assembly 200 are shown in FIGS. 9-13. Gripper block 250 of gripper assembly 200 has a central or longitudinal axis 255 (shown in FIGS. 10, 11), a pair of opposing longitudinal ends 252, and a pair of opposing lateral sides 254 extending between ends 252. In this embodiment, gripper block 250 has an axial maximum length 250L (shown in FIG. 10) extending along central axis 255 and between ends 252, and a maximum width 250W extending orthogonal central axis 255 and between sides 254 of gripper block 250. In this embodiment, the maximum length 250L of gripper block 250 is greater than the maximum width 250W of gripper block 250.

Gripper block 250 includes a first or gripper surface 256 and a second or bottom surface 258 oriented generally opposite gripper surface 256. Gripper surface 256 is generally curved and configured to receive and grip a portion of the outer surface of coiled tubing 22. Particularly, in this embodiment, gripper surface 256 is generally semi-circular in cross-section and comprises a plurality of ridges 257 to enhance the frictional coupling between gripper block 250 and the coiled tubing 22 during the operation of coiled tubing injector 100; however, in other embodiments, the configuration of gripper surface 256 may vary.

Gripper block 250 additionally includes a pair of receptacles 260 formed in the sides 254 of gripper block 250. Each receptacle 260 is defined by a curved inner surface 262 that is configured to receive the indent 246 of clip 242 to thereby lock gripper block 250 to carrier 202. Each side 254 of gripper block 250 includes a receptacle 260 so that gripper block 250 may be coupled to carrier 202 in either axial orientation. In other words, it does not matter which side 254 of gripper block 250 faces clip 242 when gripper block 250 is coupled to carrier 202. However, in other embodiments, only a single side 254 of gripper block 250 may include a receptacle 260.

A pair of elongate members or rails 264 extend from bottom surface 258, each rail 256 extending along one of the ends 252 of gripper block 250 in a direction orthogonal the central axis 255 of gripper block 250. Each end 252 of gripper block 250 comprises a plurality of rails spaced across the end 252. Particularly, along each end 252 of gripper block 250, a first rail 264 is positioned at a first side 254, a second rail 264 is positioned at the opposing side 254, and a third rail 264 is positioned equidistantly between the first and second rails 264. In this configuration, along each end 252 of gripper block 250, a pair of openings or gaps 266 (shown in FIG. 11) are formed between the three rails 264. In other embodiments, the number of gaps 266 formed between rails 264 may vary. Additionally, rails 264 comprise locking members or gripper keys 268 which extend orthogonally from rails 264 and inwards in a direction parallel with central axis 255 from ends 252 of gripper block 250. Each rail 264 and corresponding gripper key 268 form an L-shaped cross-sectional profile that defines a groove or channel 270 extending between bottom surface 258 and an inner surface of gripper key 268. In other embodiments, the cross-sectional profile of each rail 264 and corresponding gripper key 268 may vary.

Figure 14:
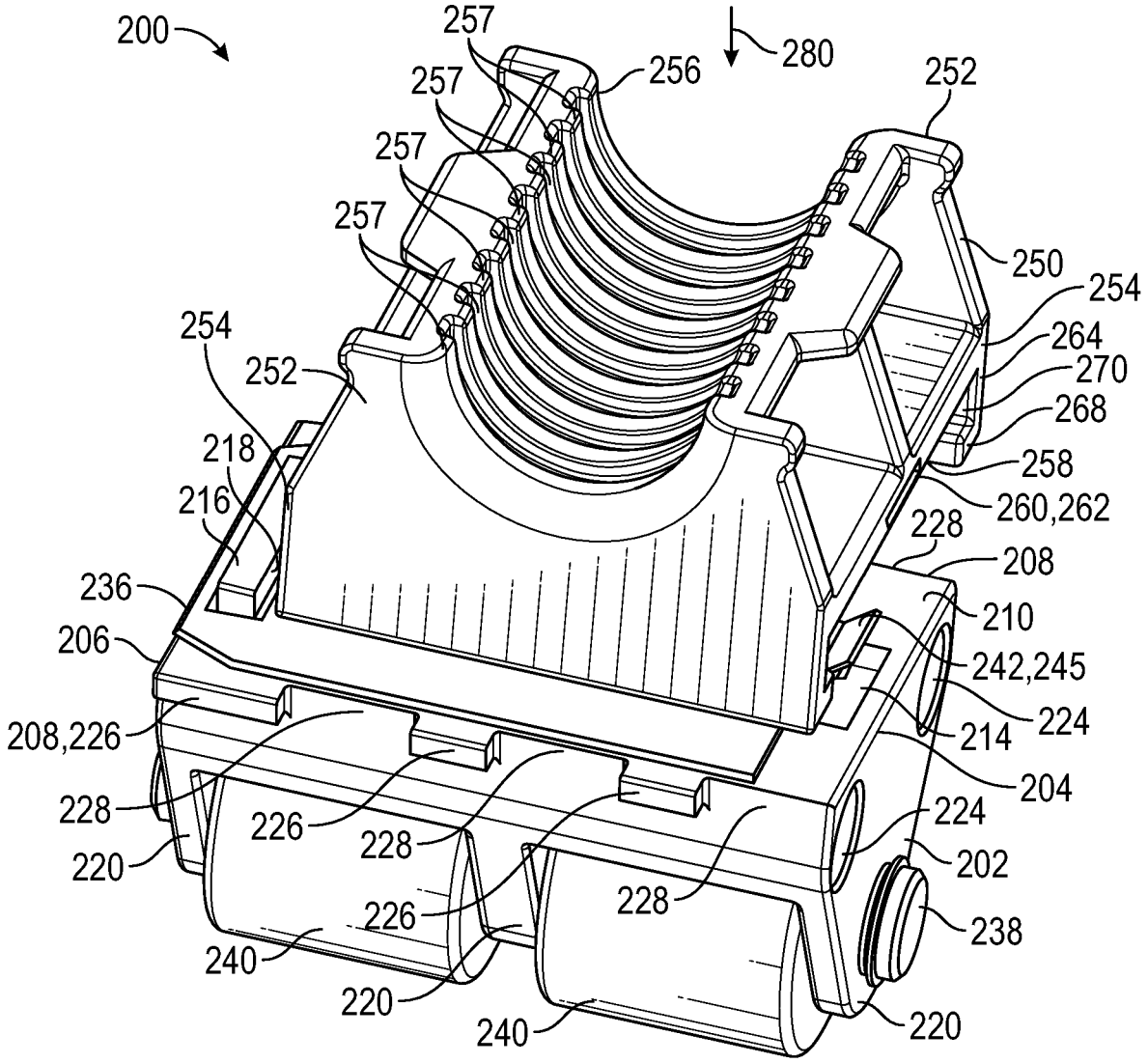
FIGS. 14, 15 are additional perspective views of the gripper assembly of FIGS. 3, 4.
Figure 15:
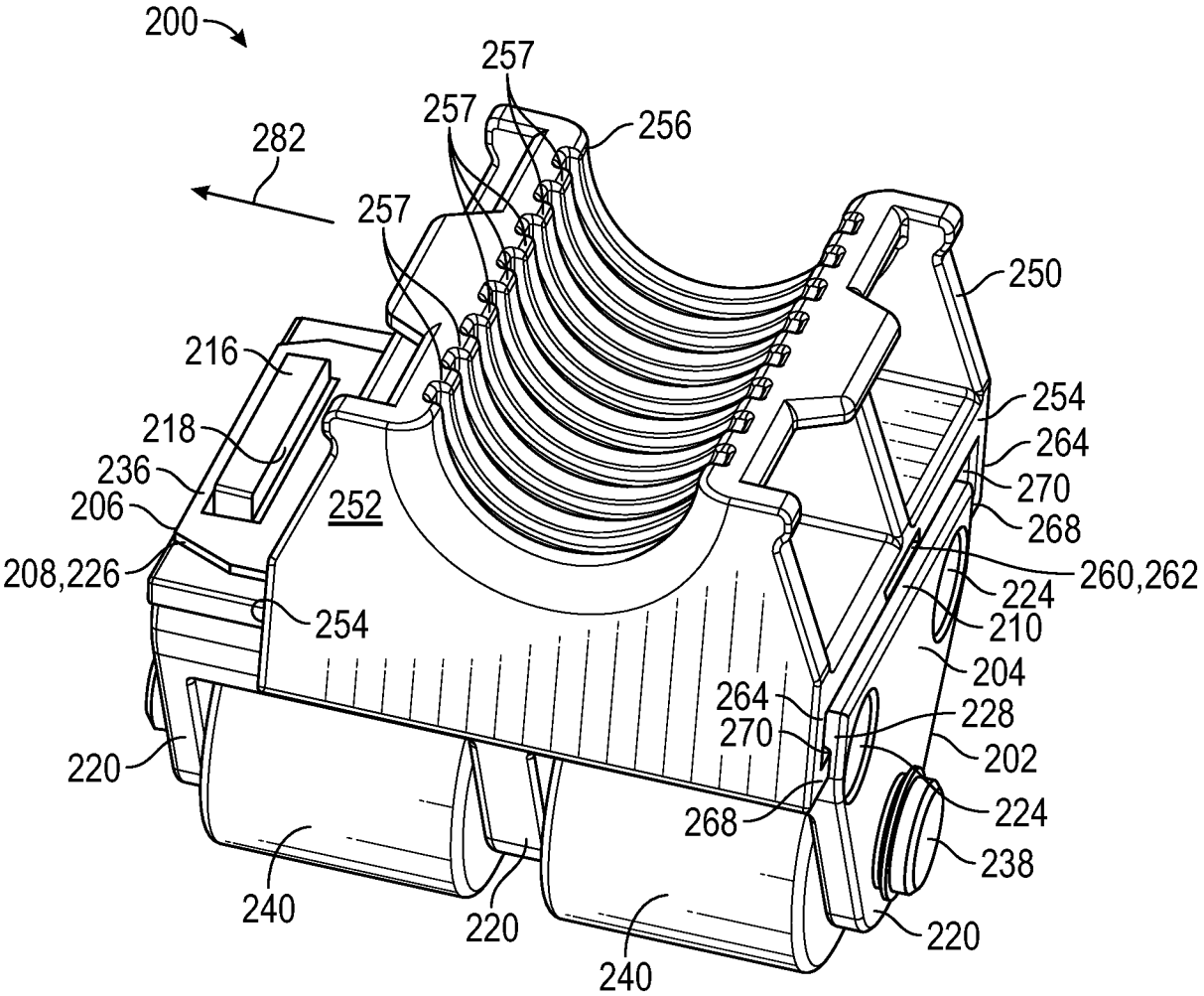

Referring to FIGS. 14, 15 additional views of gripper assembly 200 are shown. Particularly, FIGS. 14, 15 illustrate a method for assembling the gripper block 250 with carrier 202 to form gripper assembly 200. As shown particularly in FIG. 14, with the bottom surface 258 of gripper block 250 spaced from the top surface 210 of carrier 202, carrier 250 may be positioned such that each gripper key 268 of gripper block 250 aligns with one of the gaps 228 of carrier 202. Once gripper keys 268 of gripper block 250 are aligned with gaps 228 of carrier 202, gripper block 250 may be displaced in a first or vertical direction (indicated by arrow 280 in FIG. 14) relative to carrier 202. The vertical direction 280 may be orthogonal to the central axes 205, 255 of carrier 202 and gripper block 250, respectively.

As gripper block 250 travels in the vertical direction 280, each gripper key 268 of gripper block 250 passes entirely through a corresponding gap 228 of carrier 202. Additionally, once gripper keys 268 have passed through gaps 228, the bottom surface 258 of gripper block 250 contacts the gasket 236 positioned on the top surface 210 of carrier 202, thereby arresting the relative movement of gripper block 250 in the vertical direction 280. Further, as the bottom surface 258 of gripper block 250 enters into contact with gasket 236, clip 242 is elastically deformed whereby handle 245 is flexed towards receptacle 214. Handle 245 of clip 242 may be flexed towards receptacle 214 into an unlocked position by an operator of gripper assembly 200 contacting and manually forcing handle 245 towards receptacle 214, and/or via contact between handle 245 and the bottom surface 258 of gripper block 250.

As shown particularly in FIG. 15, following contact between the bottom surface 258 of gripper block 250 and the gasket 236 positioned on the top surface 210 of carrier 202, gripper block 250 may be slidably displaced in a second or horizontal direction (indicated by arrow 282 in FIG. 15) orthogonal the vertical direction 280 and towards the second end 206 of carrier 202. The horizontal direction 282 may be parallel to the central axis 205 of carrier 202 but orthogonal to the central axis 255 of gripper block 250. Gripper block 250 travels in the horizontal direction 282 until an end 254 of gripper block 250 contacts the stop surface 218 of ledge 216, preventing further travel of gripper block 250 in the horizontal direction 282.

With gripper block 250 contacting or positioned directly adjacent the stop surface 218 of ledge 216, each gripper key 268 of gripper block 250 is aligned with a corresponding carrier key 226 of carrier 202 while each carrier key 226 is received within a channel 270 of gripper block 250, thereby preventing relative movement between gripper block 250 and carrier 202 in the vertical direction 280. Additionally, with gripper block 250 contacting or positioned directly adjacent the stop surface 218 of ledge 216, clip 242 is permitted to return to its original or locked position prior to bottom surface 258 of gripper 250 contacting the gasket 236 positioned on the top surface 210 of carrier 202. Particularly, the indent 246 of clip 242 is permitted to enter into one of the receptacles 260 of gripper block 250. In some embodiments, clip 242 may be biased to return to its original position whereby indent 246 automatically snaps into receptacle 260 once indent 246 clears the bottom surface 258 of gripper block 250. With one side 254 of gripper block 250 contacting or positioned directly adjacent the stop surface 218 of ledge 216 and with indent 246 of clip 242 received in the receptacle 260 formed in the opposing side 254 of gripper block 250, relative movement between gripper block 250 and carrier in the horizontal direction 282 is restricted. Thus, following the insertion of indent 246 into the receptacle 260 of gripper block 250, gripper block 250 is fully coupled to carrier 202 to form gripper assembly 200. The formed gripper assembly 200 may then be installed in coiled tubing injector 100 for use in the coiled tubing system 20 shown in FIG. 1.

Referring generally to FIGS. 2-11, the maximum width 250W of gripper block 250 is greater than the maximum width 202W of carrier 202, thereby permitting gripper block 250 to slide over carrier 202 and around carrier keys 226 of carrier 202 whereby gripper block 250 extends partially around or encloses carrier 202. By configuring the gripper block 250 to slide over and partially enclose carrier 202, the costs of manufacturing gripper assembly 200 may be minimized. Particularly, by having gripper block 250 slide over and partially enclose carrier 202 (rather than having gripper block 250 slide into a receptacle formed in carrier 202), the overall amount of material collectively comprising carrier 202 and gripper block 250 may be minimized. The cost savings associated with producing each gripper assembly 200 may be magnified by the relatively larger number of gripper assemblies 200 of which coiled tubing injector 100 is comprised. Further, the machining of carrier 202 and/or gripper block 250 may be simplified in this configuration and while also allowing for quick and convenient replacement of the gripper block 250 (e.g., due to either damage to the gripper block 250 or to change the gripper block 250 for a gripper block of a different size) without needing to disassemble and remove the chain the endless chain 130 to which the gripper block 250 is coupled.

Additionally, the cost of manufacturing or producing each gripper assembly 200 is further minimized by the configuration of clip 242 which only comprises a single member or body of a given material having a minimal cost to manufacture relative to more complex designs. For example, instead of comprising a separate or distinct biasing element or mechanism, clip 242 utilizes the elasticity of the material comprising clip 242 itself to allow for clip 242 to be flexed between the unlocked position permitting gripper block 250 to be slid over carrier 202 and the locked position securing gripper block 250 to carrier 202.

Figure 16:
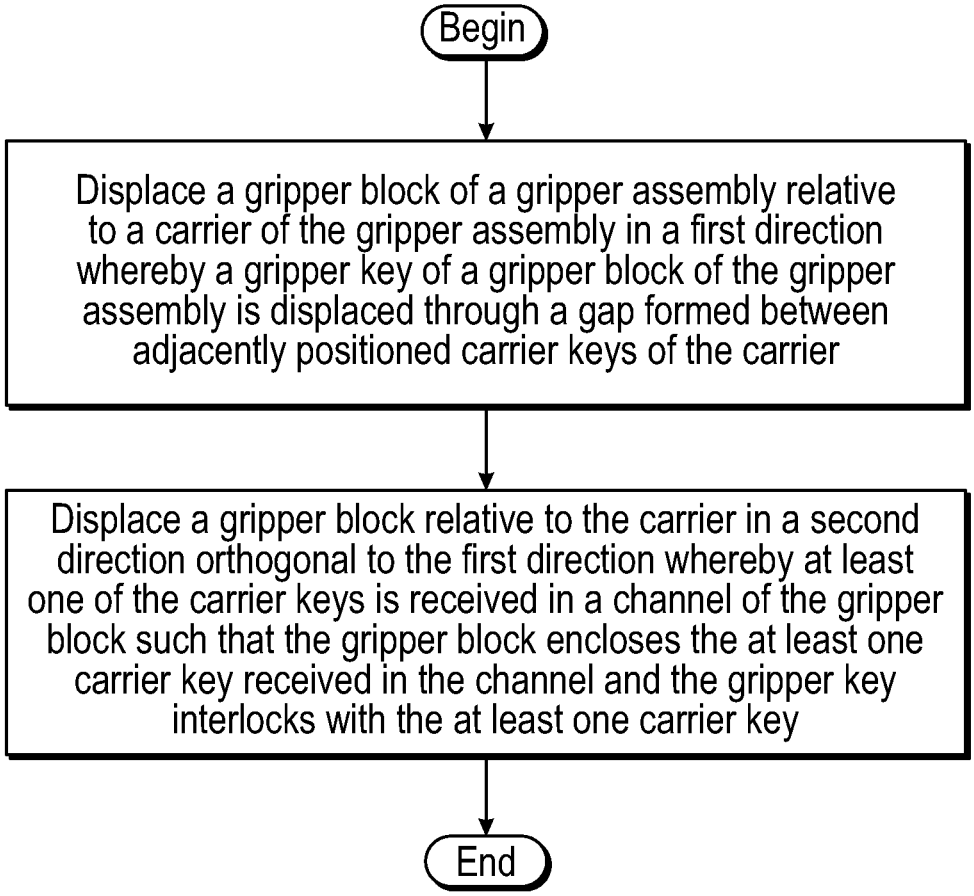
FIG. 16 is a flowchart of a method for assembling a gripper assembly for a coiled tubing injector.

Referring to FIG. 16, an embodiment of a method 300 for assembling a gripper assembly for a coiled tubing injector is shown. Initially, block 302 of method 300 comprises displacing a gripper block of the gripper assembly relative to a carrier of the gripper assembly in a first direction whereby a gripper key of a gripper block of the gripper assembly is displaced through a gap formed between adjacently positioned carrier keys of the carrier. In some embodiments, block 302 comprises displacing gripper block 250 of gripper assembly 200 relative to carrier 202 of assembly 200 in vertical direction 280 whereby one of the gripper keys 268 of gripper block 250 is displaced through one of the gaps 228 of carrier 202, as shown in FIG. 14.

At block 304, method 300 comprises displacing the gripper block relative to the carrier in a second direction orthogonal to the first direction whereby at least one of the carrier keys is received in a channel of the gripper block such that the gripper block encloses the at least one carrier key received in the channel and the gripper key interlocks with the at least one carrier key. In some embodiments, block 304 comprises displacing gripper block 250 relative to carrier 202 in the horizontal direction 282 whereby at least one of the carrier keys 226 of carrier 202 is received in one of the channels 270 of gripper block 250 such that gripper block 250 encloses the at least one carrier key 226 received in the channel 270 and the gripper key 268 interlocks with the at least one carrier key 226.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A gripper assembly for a coiled tubing injector, comprising:

a gripper block configured to grip a tubular member, wherein the gripper block comprises a pair of gripper lateral sides, a gripper key, and a channel;

a carrier configured to couple to a chain of the coiled tubing injector, wherein the carrier comprises a carrier key, wherein the carrier key is receivable within the channel of the gripper block whereby the gripper block encloses the carrier key and the gripper key interlocks with the carrier key; and a clip comprising a first end coupled to the carrier, a second end opposite the first end, a handle located at the second end, and a curved indent positioned between the first end and the second end and receivable within a receptacle extending into one of the pair of gripper lateral sides to lock the gripper block to the carrier.

2. The gripper assembly of claim 1, wherein the gripper block comprises a first end, a second end opposite the first end, a bottom surface, the pair of gripper lateral sides extending between the first end and the second end, a gripper surface configured to grip the tubular member, and a rail positioned along one of the first end and the second end of the gripper block and extending from the bottom surface of the gripper block and oriented opposite the gripper surface.

3. The gripper assembly of claim 2, wherein the gripper key extends orthogonally from the rail, and wherein the gripper key and the rail define the channel in which the carrier key is receivable.

4. The gripper assembly of claim 2, wherein the carrier comprises a first end, a second end opposite the first end, a pair of carrier lateral sides extending between the first end and the second end, and a top surface configured to slidably engage the bottom surface of the gripper block, and wherein the carrier key extends from one of the pair of carrier lateral sides.

5. The gripper assembly of claim 4, wherein:

the gripper block has a maximum length extending between the first end and the second end and a maximum width extending between the pair of gripper lateral sides, wherein the maximum length is greater than the maximum width;

the carrier has a maximum length extending between the first end and the second end and a maximum width extending between the pair of carrier lateral sides, wherein the maximum length of the carrier is greater than the maximum width of the carrier; and the maximum length of the gripper block is greater than the maximum width of the carrier.

6. The gripper assembly of claim 4, wherein the carrier comprises a ledge extending from the top surface and configured to engage one of the pair of gripper lateral sides when the carrier key is received within the channel of the gripper block.

7. The gripper assembly of claim 4, wherein:

a plurality of the gripper keys are positioned along the first end and the second end of the gripper block;

a plurality of the carrier keys are positioned along the pair of carrier lateral sides; and the plurality of carrier keys define a plurality of gaps extending between adjacently positioned carrier keys of the plurality of carrier keys, and wherein each of the plurality of gripper keys are displaceable through the plurality of gaps.

8. The gripper assembly of claim 1, wherein the indent of the clip comprises a bend of between 30 degrees and 120 degrees.

9. A coiled tubing injector, comprising:

a frame, wherein a drive sprocket is coupled to the frame;

a chain driven by the drive sprocket, wherein a plurality of gripper assemblies are coupled to the chain;

a traction skate configured to apply a clamping force against the plurality of gripper assemblies;

wherein at least one gripper assembly of the plurality of gripper assemblies comprises:

a gripper block configured to grip a tubular member, wherein the gripper block comprises a pair of gripper lateral sides, a gripper key, and a channel;

a carrier configured to couple to the chain of the coiled tubing injector, wherein the carrier comprises a carrier key, wherein the carrier key is receivable within the channel of the gripper block whereby the gripper block encloses the carrier key and the gripper key interlocks with the carrier key; and a clip coupled to the carrier and comprising a first end coupled to the carrier, a second end opposite the first end, a handle located at the second end, and a curved indent positioned between the first end and the second end and receivable within a receptacle extending into one of the pair of gripper lateral sides to lock the gripper block to the carrier.

10. The coiled tubing injector of claim 9, wherein the gripper block comprises a first end, a second end opposite the first end, a bottom surface, the pair of gripper lateral sides extending between the first end and the second end, a gripper surface configured to grip the tubular member, and a rail positioned along one of the first end and the second end of the gripper block and extending from the bottom surface of the gripper block oriented opposite the gripper surface.

11. The coiled tubing injector of claim 10, wherein the gripper key extends orthogonally from the rail, and wherein the gripper key and the rail define the channel in which the carrier key is receivable.

12. The coiled tubing injector of claim 10, wherein the carrier comprises a first end, a second end opposite the first end, a pair of carrier lateral sides extending between the first end and the second end, and a top surface configured to slidably engage the bottom surface of the gripper block, and wherein the carrier key extends from one of the pair of carrier lateral sides.

13. The coiled tubing injector of claim 12, wherein:

the gripper block has a maximum length extending between the first end and the second end and a maximum width extending between the pair of gripper lateral sides, wherein the maximum length is greater than the maximum width;

the carrier has a maximum length extending between the first end and the second end and a maximum width extending between the pair of carrier lateral sides, wherein the maximum length of the carrier is greater than the maximum width of the carrier; and the maximum length of the gripper block is greater than the maximum width of the carrier.

14. The coiled tubing injector of claim 12, wherein:

the carrier comprises a ledge extending from the top surface and configured to engage one of the pair of gripper lateral sides when the carrier key is received within the channel of the gripper block.

15. The coiled tubing injector of claim 9, wherein the indent of the clip comprises a bend of between 30 degrees and 120 degrees.

16. A method of assembling a gripper assembly for a coiled tubing injector, comprising:

(a) displacing a gripper block of the gripper assembly relative to a carrier of the gripper assembly in a first direction whereby a gripper key of the gripper block of the gripper assembly is displaced through a gap formed between adjacently positioned carrier keys of the carrier; and (b) displacing the gripper block relative to the carrier in a second direction orthogonal to the first direction whereby at least one of the carrier keys is received in a channel of the gripper block such that the gripper block encloses the at least one carrier key received in the channel and the gripper key interlocks with the at least one carrier key;

(c) applying a force to a handle of a clip as the gripper block is displaced relative to the carrier, the clip extending between a first end coupled to the carrier and a second end opposite the first end and comprising the handle; and (d) releasing the handle of the clip following (c) whereby a curved indent positioned between the first end and the second end of the clip is received within a receptacle extending into one of a pair of gripper lateral sides of the gripper block to lock the gripper block to the carrier.

17. The method of claim 16, wherein:

the gripper block comprises a first end, a second end opposite the first end, the pair of gripper lateral sides extending between the first end and the second end, a gripper surface configured to grip the tubular member, and a rail positioned along one of the first end and the second end of the gripper block and extending from a bottom surface of the gripper block oriented opposite the gripper surface; and the carrier comprises a first end, a second end opposite the first end, a pair of carrier lateral sides extending between the first end and the second end, and a top surface configured to slidably engage the bottom surface of the gripper block, and wherein the carrier key extends from one of the pair of carrier lateral sides.

18. The method of claim 17, wherein:

the gripper block has a maximum length extending between the first end and the second end and a maximum width extending between the pair of gripper lateral sides, wherein the maximum length is greater than the maximum width;

the carrier has a maximum length extending between the first end and the second end and a maximum width extending between the pair of carrier lateral sides, wherein the maximum length of the carrier is greater than the maximum width of the carrier; and the maximum length of the gripper block is greater than the maximum width of the carrier.

* * * * *